United States Patent [19]

Martin

[11] Patent Number: 4,754,503

[45] Date of Patent: Jul. 5, 1988

[54] SHAMPOO SUPPORT FOR CHILDREN

[76] Inventor: Ida M. Martin, Rte. 3, Box 365, Center, Tex. 75935

[21] Appl. No.: 35,728

[22] Filed: Apr. 8, 1987

[51] Int. Cl.[4] ..... A45D 19/00

[52] U.S. Cl. ..... 4/517; 4/515; 4/521; 4/523

[58] Field of Search ..... 4/515–523

[56] References Cited

U.S. PATENT DOCUMENTS

| | | | |
|---|---|---|---|
| 1,868,598 | 7/1932 | Gower | 4/518 |
| 2,425,513 | 8/1947 | Czajcinski et al. | 4/515 |
| 2,461,744 | 2/1949 | Lafield | 4/517 |
| 2,463,049 | 3/1949 | Onsa | 4/517 |
| 3,428,361 | 2/1969 | Reynolds | 4/517 X |
| 3,449,771 | 6/1969 | Watson | 4/515 |
| 3,633,222 | 1/1972 | Greenfield | 4/517 |
| 4,352,216 | 10/1982 | Grim | 4/523 |

*Primary Examiner*—Henry K. Artis
*Attorney, Agent, or Firm*—John M. Harrison

[57] ABSTRACT

A shampoo support for children which includes a support frame with contoured neck support padding and back support padding located between parallel frame sides and a flexible mat for receiving the lower back and hips of a child. A back support end defines one end of the support frame and is positioned adjacent to and beneath the neck support, to support a net or sieve for receiving the hair of the child during a shampoo. Support legs extend beneath the support frame for orienting the support frame in a selected angular configuration on a flat surface and in a preferred embodiment, one end of the flexible mat is attached to the back support edge of the support frame, with the opposite end attached to a spindle and the mat is rolled on the spindle when the shampoo support is not in use.

18 Claims, 1 Drawing Sheet

SHAMPOO SUPPORT FOR CHILDREN

BACKGROUND OF THE INVENTION

1. Field of the Invention

This invention relates to devices for shampooing children's hair and more particularly, to a shampoo support for children which is characterized by a support frame provided with parallel side members, a padded back support and a contoured and padded neck support, along with a flexible mat for receiving the lower back, hips and legs of a child. When the shampoo support is in use and the neck is supported by the neck support, the child's hair hangs downwardly in a net which extends from an end segment of the support frame. In a preferred embodiment, one edge of the flexible mat is attached to the back support edge of the support frame and the flexible mat can be rolled on a spindle secured to the opposite edge of the mat and stored in a pair of spindle brackets attached to the side members when the shampoo support is not in use. In functional configuration, the shampoo support is oriented to position the support frame in angular relationship with respect to the horizontal by means of support legs extending from the support frame. When the shampoo support is set up for use, the spindle is easily removed from the brackets and the flexible mat is rolled from the spindle and extended downwardly from the back support edge of the support frame. Earplugs or ear caps which are attached to the support frame by means of a tether for use during a shampoo, can be applied in or to the child's ears to prevent water and soap from entering the ears.

One of the problems realized in shampooing the hair of infants and small children is that of properly and safely positioning the child on a sink or in a tub and then supporting the child while washing the hair. If the child is placed on a sink for washing the hair, the shampooing operation can be dangerous, since the child can easily fall from the sink to the floor or into the sink if he or she is not closely watched. Furthermore, unless two people are involved in handling the shampoo, there is no efficient and reliable way of resting the child's shoulder and neck on the sink edge, in order to allow the hair to extend into the sink for more efficient washing.

The shampoo support for children detailed in this patent application is designed with the comfort and security of small children in mind and presents an easy and safe technique for shampooing a child's hair. The device further aids in keeping water and shampoo out of the child's eyes and ears, a problem which is not only inadvisable for medical reasons, but also scares the child. The shampoo support of this invention also frees both of the mother or father's hands for the shapooing operation.

DESCRIPTION OF THE PRIOR ART

Various types of supports and aids for use in shampooing childrens' and infants' hair are known in the art. U.S. Pat. No. 2,474,572, dated June 28, 1949, to H. B. Brose, et al, discloses a "Child's Shampoo Board". The shampoo board detailed in this patent includes a curved, flexible support stretched over a frame for placing near a container or sink and allowing the hair to extend downwardly for shampooing purposes. The shampoo board can be disassembled for ease of storing and is provided with a strap for securing the child in position. U.S. Pat. No. 3,337,263, dated Aug. 22, 1967, to C. I. Reynolds, discloses a "Child's Shampoo Chair". The shampoo chair detailed in this patent is characterized by a side bracket provided with a pair of clamping members for clamping to the sink bowl and a cooperating outwardly-extending, adjustable member provided with a sliding seat for supporting the child. A curved neck support is attached to the mount bracket for receiving the neck of the child, such that the hair can be extended into the sink and washed while the child is supported in the seat portion of the device. An "Adjustable Child's Shampoo Chair" is detailed in U.S. Pat. No. 3,428,361, dated Feb. 18, 1969, to C. I. Reynolds. The shampoo chair of this invention is an improvement of the "Child's Shampoo Chair" detailed in U.S. Pat. No. 3,337,263. U.S. Pat. No. 3,545,012, dated Dec. 8, 1970, to C. A. Espin, discloses an "Infant's Shampoo Accessory". The shampoo accessory is characterized by a molded support tray provided with a rounded neck support at one end for situating upon a sink and receiving a child, such that the hair is allowed to extend downwardly into the sink from the neck support portion of the accessory. The support tray has an upward-standing lip around the periphery thereof and drain holes facilitate drainage of water from the tray portion into the sink. A "Portable Shampoo Tray" is detailed in U.S. Pat. No. 4,196,478, dated Apr. 8, 1980, to Richard J. Cowell. The shampoo tray of this invention utilizes a body-supporting sheet having a notch adapted to receive the neck of a user. The body-supporting sheet is pivotally secured to a pair of arms, each having suction cups fastened to the lower surfaces thereof. A pair of struts are pivotally secured to the arms, with the uppermost ends of the struts disposed in one of a plurality of socket-like cavities located along the marginal edges of the supporting sheet. An open-mouth container is secured to the marginal edge of the supporting sheet for receiving articles utilized in a hair shampooing operation and the apparatus may be folded such that the arms and struts form a package when not in use. U.S. Pat. No. 4,295,683, dated Oct. 20, 1981, entitled "Orthopedic Chair" to David T. Dubbinik, discloses an orthopedic chair which is designed primarily for bathing handicapped individuals and includes a sling-type body supported by an adjustable frame. In the portion supporting the legs, two U-shaped, rigid members support and divide the sling into two U-shaped slings, to individually support and separate the legs. The upper portion adjacent the head is releasable, to free the head and provide access for washing the head and the hair. By reclining the chair and releasing the head-supporting portion of the device, the head and hair of the individual are placed in close proximity to the water in a bathtub. Additionally, the structure provides a grip for the individual when in such a reclining position.

It is an object of this invention to provide a new and improved shampoo support for children, which is characterized by a support frame that is contoured to receive the neck and body for a child, a flexible mat extending from the support frame for receiving the hips and legs of the child and a net extending beneath the neck portion of the frame for receiving the hair of the child, in order to facilitate shampooing the hair.

Another object of this invention is to provide a new and improved, portable shampoo support for children, which shampoo support can be positioned in a bathtub or on a sink or lavatory and is shaped and designed to free the hands of the user for shampooing the hair of the children.

Yet another object of this invention is to provide a new and improved shampoo aid or support for supporting and positioning a child such that the child's hair hangs into a sink, basin or bathtub and water and shampoo are kept out of the child's ears and wherein the shampoo aid frees the hands of the user undertaking the shampooing operation.

Yet another object of this invention is to provide a new and improved shampoo support for children, which is characterized by a contoured and padded neck support and a contiguous, padded back support located in an angularly-disposed support frame, with a flexible or rigid net removably carried by the frame to receive the downwardly-extending hair and facilitating washing of the hair.

A still further object of the invention is to provide a new and improved shampoo aid for supporting and shampooing the hair of children, which shampoo aid is characterized by a contoured support frame provided with a rounded and padded neck portion, a padded back support, parallel side members spanning the neck portion and back support and a flexible mat attached to the support frame for receiving the body of the infant, with the hair extending downwardly into a net carried by the support frame, in order to better facilitate washing the hair.

SUMMARY OF THE INVENTION

These and other objects of the invention are provided in a shampoo support for children, which includes a support frame provided with parallel side members, a contoured and padded neck support and a padded back support extending from the neck support and located between the side members and a flexible mat having one end attached to the back support edge of the back support and extendable outwardly of the back support edge to receive the hips, legs and feet of a child. The child is positioned on his or her back with the neck oriented against the neck support and the hair extended downwardly into a net removably carried by the support frame, in order to facilitate shampooing of the hair in a sink, basin or bathtub, as desired. The flexible mat is rolled on a spindle and the spindle is inserted in opposed brackets mounted on the side members when the shampoo support is not in use.

BRIEF DESCRIPTION OF THE DRAWING

The invention will be better understood by reference to the accompanying drawings, wherein.

DESCRIPTION OF THE PREFERRED EMBODIMENTS

Figure 1:
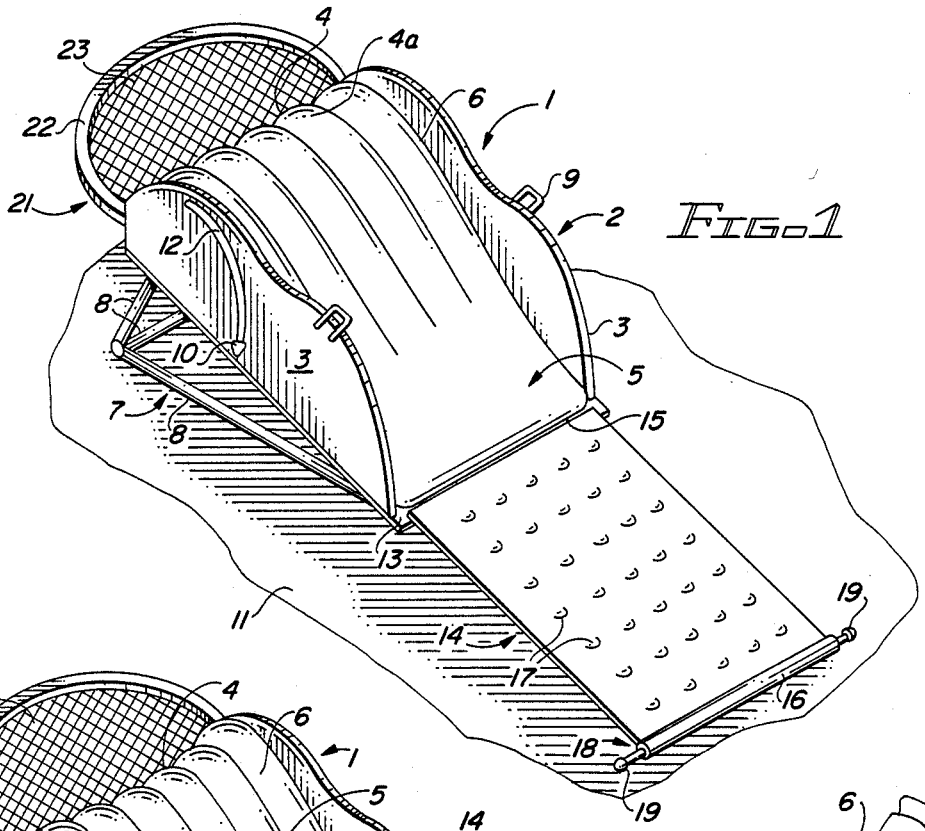
FIG. 1 is a perspective view of a preferred embodiment of the shampoo support for children of this invention, illustrated in functional, shampooing configuration.

Referring initially to FIG. 1 of the drawing the shampoo support of this invention is generally illustrated by reference numeral 1. The shampoo support 1 is characterized by a shaped support frame 2, which includes a pair of parallel frame sides 3 and a back support 5, which terminates at the top end of the support frame 2, in a neck support 4, as illustrated. In a preferred embodiment of the invention, the back support 5 is provided with back support padding 6 and the neck support 4 fitted with neck support padding 4*a*. The support frame 2 is supported in angular relationship with respect to a supporting surface 11 by support legs 7, which are defined by leg struts 8 and are mounted to the underside of the support frame 2, as illustrated. A pair of spindle brackets 9 extend upwardly from each of the frame sides 3 in spaced, facing relationship, for a purpose which will be hereinafter described. A pair of ear plugs 10 are attached to the frame sides 3 by means of ear plug tethers 12, for insertion in the ears of a child during shampooing, in order to prevent water from entering the ear. It is understood by those skilled in the art that cups or similar covers may also be used in lieu of the earplugs 10, for protecting the ears of children who are not comfortable with insertion of the ear plugs 10 in their ears. The back support 5 extends downwardly in angular relationship and terminates in a back support edge 13, which receives and secure the base edge 15 on a flexible mat 14. The flexible mat 14 is further characterized by optional non-slip bubbles 17 and extends from the back support edge 13 to a spindle edge 16, which is attached to a spindle 18. In a preferred embodiment, the spindle 18 is further provided with enlarged spindle retainers 19 on each end thereof, for purposes which will be hereinafter described.

Figure 2:
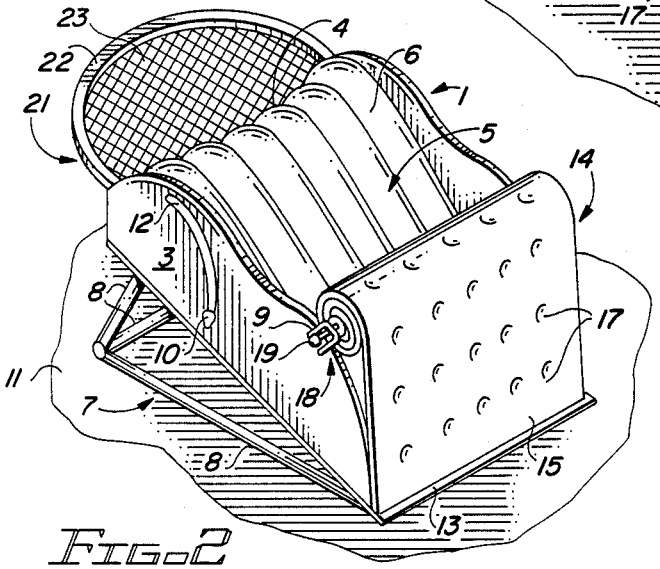
FIG. 2 is a perspective view of the shampoo support for children illustrated in FIG. 1, with the flexible mat deployed on a spindle in stored configuration.

Referring now to FIG. 2 of the drawings, when the shampoo support 1 is in non-functional, stored configuration, the flexible mat 14 is wound or rolled on the spindle 18 and the spindle retainers 19 are inserted in the spindle brackets 9, to retain the flexible mat 14 in rolled configuration.

Figure 3:
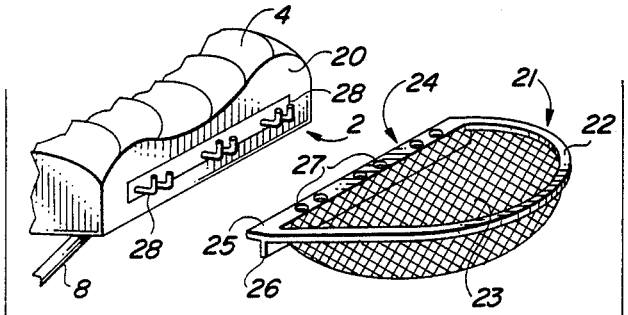
FIG. 3 is a perspective view, partially in section, of the back support end of the shampoo support, more particularly illustrating a preferred means for attaching a net thereto.

As illustrated in FIG. 3 of the drawings, in a preferred embodiment of the invention the back support end 20 of the support frame 2 is fitted with multiple, L-shaped net hooks 28, in order to receive and mount a net 21. In a most preferred embodiment of the invention the net 21 is characterized by a substantially rigid net mesh 23, mounted to a net frame 22 and a companion frame flange 24, which is attached to the net frame 22. The frame flange 24 is further characterized by a top flange plate 25, which extends outwardly in horizontal configuration and is provided with spaced hook openings 27, for engaging the net hooks 28 and removably supporting the net 21 on the support frame 2 at the back support end 20. A bottom flange plate 26 projects downwardly from the top flange plate 25 in perpendicular relationship, for engaging the back support end 20 when the net 21 is mounted on the back support end 20 of the support frame 2.

Figure 4:
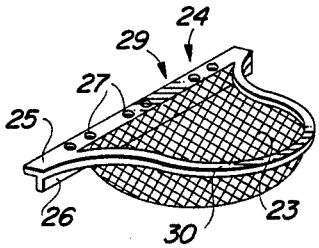
FIG. 4 is a perspective view of an alternative contoured net for use with the shampoo support illustrated in FIGS. 1 and 2.

Referring now to FIG. 4 of the drawings, in another preferred embodiment of the invention a contoured net 29 is illustrated, with a contoured frame 30 terminated by a frame flange 24 and a net mesh 23 mounted on the contoured frame 30 and the frame flange 24. As in the case of the frame flange 24 illustrated in FIG. 3, the frame flange 24, illustrated in FIG. 4, is further characterized by a horizontally disposed top flange plate 25 and a bottom flange plate 26, with hook openings 27 provided in the top flange plate 25, for mounting on the net hooks 28, illustrated in FIG. 3.

Figure 5:
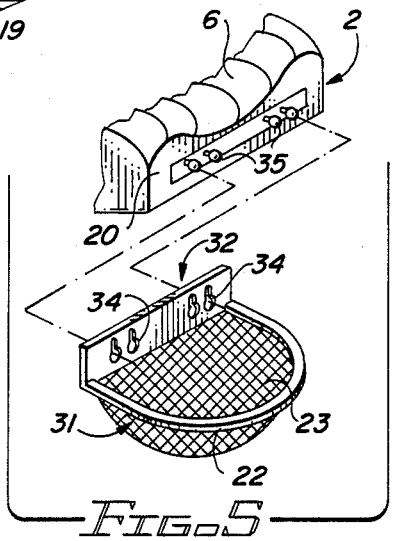
FIG. 5 is a perspective view of the back support end of the shampoo support and an alternative net, more particularly illustrating alternative keyhole slots for mounting the net on the back support end.

Referring now to FIG. 5 of the drawings, in yet another preferred embodiment of the invention a key slot net 31 is illustrated, with a net frame 22 receiving an upward-standing key slot flange 32 and a net mesh 23 secured to the net frame 22 and the key slot flange 32, as illustrated. Multiple key slots 34 are provided in the upward-standing key slot flange 32, for receiving multiple key pins 35, which extend from the back support end 20 of the support frame 2.

It will be appreciated by those skilled in the art that the shampoo support for children of this invention is characterized by ease in transportation, storage and use and is designed to accommodate children of substantially any age, but small children and infants in particular. The shampoo support 1 can be used on the edge of a sink, in a bathtub or on a lavatory and is designed to quickly and easily facilitate shampooing of the hair with a minimum of trauma to the child. The shampoo support 1 is portable and a variety of net configurations in addition to the net 21, contoured net 29 and key slot net 31, can be mounted to the support frame 2, in order to receive the hair of the child during the shampooing operation. Furthermore, while the net mesh 23 in the net 21, contoured net 29 and key slot net 31 is most preferably shaped from a substantially rigid plastic material by injection—molding or other techniques, the net 21 can also be shaped of metal mesh or other materials, both flexible and inflexible, according to the knowledge of those skilled in the art.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A shampoo support for supporting a child, comprising a support frame adapted to rest on a supporting surface; a neck support provided in said support frame for supporting the neck and head of the child while the hair extends downwardly of said neck support; a back support provided in said support frame, said back support extending from said neck support to a back support edge, for supporting the back of the child; a flexible mat carried by said support frame for receiving the hips and legs of the child while the hair is shampooed; and bracket means carried by said support frame and spindle means carried by said flexible mat, whereby said flexible mat is rolled in said spindle means and said spindle means engages said bracket means when said shampoo support is not in use.

2. The shampoo support of claim 1 further comprising net means carried by said support frame adjacent said neck support for receiving the hair of the child.

3. The shampoo support of claim 1 further comprising at least one support leg carried by said support frame for supporting said support frame in angular relationship on the supporting surface.

4. The shampoo support of claim 1 further comprising a pair of frame sides provided in substantially parallel, spaced relationship in said support frame, said frame sides spanning said neck support and said back support.

5. The shampoo support of claim 1 further comprising a pair of frame sides provided in substantially parallel, spaced relationship in said support frame, said frame sides spanning said neck support and said back support.

6. The shampoo support of claim 5 wherein said bracket means further comprises a pair of generally U-shaped brackets fixedly attached to said frame sides for receiving the ends of said spindle when said flexible mat is rolled on said spindle.

7. The shampoo support of claim 6 further comprising:

(a) net means carried by said support frame adjacent said neck support for receiving the hair of the child; and (b) at least one support leg carried by said support frame for supporting said support frame in angular relationship on the supporting surface.

8. The shampoo support frame of claim 7 wherein said net means further comprises a substantially rigid net frame, a frame flange carried by said net frame; a net carried by said net frame and said frame flange; and fastening means provided in said support frame and said frame flange for securing said net flange, said net frame and said net to said support frame.

9. The shampoo support of claim 8 wherein said fastening means further comprises at least two hooks attached to said support frame in spaced relationship and at least two hook openings provided in said frame flange in spaced relationship, for receiving said hooks and removably mounting said frame flange, said net frame and said net on said support frame.

10. The shampoo support of claim 8 wherein said fastening means further comprises at least two key pins attached to said support frame in spaced relationship and at least wo key slots provided in said frame flange in spaced relationship, for receiving said key pins and removably mounting said frame flange, said net frame and said net on said support frame.

11. A shampoo support for supporting a child in position for shampooing the child's hair, comprising:

(a) a support frame and a contoured and padded neck support and a back support provided in said support frame;

(b) a support leg carried by said support frame for supporting said support frame in angular relationship on a supporting surface;

(c) a pair of frame sides extending in spaced, parallel relationship from said support frame, said frame sides spanning said neck support and said back support, respectively;

(d) a pair of generally U-shaped brackets projecting upwardly from said frame sides in spaced, facing relationship;

(e) a flexible mat having one edge attached to said support frame for receiving the hips and legs of the child in operational mode and a spindle secured to the opposite edges of said flexible mat for rolling the flexible mat on said spindle and engaging the ends of said spindle in said brackets in nonoperational mode; and (f) net means removably attached to said support frame adjacent said neck support for receiving the hair of the child.

12. The shampoo support of claim 10 wherein said net means further comprises a substantially rigid net frame, a frame flange carried by said net frame; a net carried by said net frame and said frame flange; and fastening means provided in said support frame and said frame flange; for securing said net flange, said net frame and said net to said support frame.

13. The shampoo support of claim 11 wherein said fastening means further comprises at least two hooks attached to said support frame in spaced relationship and at least two hook openings provided in said frame flange in spaced relationship, for receiving said hooks and removably mounting said frame flange, said net frame and said net on said support frame.

14. The shampoo support of claim 11 wherein said fastening means further comprises at least two key pins attached to said support frame in spaced relationship and at least two key slots provided in said frame flange in spaced relationship, for receiving said key pins and removably mounting said frame flange, said net frame and said net on said support frame.

15. A shampoo support for supporting a child in position for shampooing the child's hair, comprising:

(a) a support frame; a padded and contoured neck support provided at one end of said support frame; and a padded back support extending from said neck support to the opposite end of said support frame;

(b) support leg means carried by said support frame for supporting said support frame in angular relationship on a supporting surface;

(c) a pair of frame sides extending in spaced, parallel relationship from said support frame, said frame sides spanning said neck support and said back support, respectively;

(d) a pair of generally U-shaped brackets projecting upwardly from said frame sides in spaced, facing relationship;

(e) a flexible mat having one edge attached to said opposite end of said support frame for receiving the hips and legs of a child in operational mode and a spindle secured to the opposite edge of said flexible mat for rolling the flexible mat on said spindle and engaging the ends of said spindle in said brackets in non-operational mode; and (f) net means removably attached to said support frame adjacent said neck support for receiving the hair of the child.

16. The shampoo support of claim 15 wherein said net means further comprises a substantially rigid net frame, a frame flange carried by said net frame; a net carried by said net frame and said frame flange; and fastening means provided in said support frame and said frame flange for securing said net flange, said net frame and said net to said support frame.

17. The shampoo support of claim 16 wherein said fastening means further comprises at least two hooks attached to said support frame in spaced relationship and at least two hook openings provided in said frame flange in spaced relationship, for receiving said hooks and removably mounting said frame flange, said net frame and said net on said support frame.

18. The shampoo support of claim 16 wherein said fastening means further comprises at least two key pins attached to said support frame in spaced realtionship and at least two key slots provided in said frame flange in spaced relationship, for receiving said key pins and removably mounting said frame flange, said net frame and said net on said support frame.

* * * * *